United States Patent [19]

Dekura

[11] Patent Number: 4,898,682

[45] Date of Patent: Feb. 6, 1990

[54] CORROSION INHIBITED SYNTHETIC LUBRICANTS

[76] Inventor: Takateru Dekura, No. 1-3, Sasame-cho, Kamakura-shi, Kanagawa-ken, Japan

[21] Appl. No.: 252,104

[22] Filed: Oct. 3, 1988

[30] Foreign Application Priority Data

Aug. 11, 1988 [JP] Japan ..... 63-201749

[51] Int. Cl.[4] ..... C10M 105/70

[52] U.S. Cl. ..... 252/47.5; 252/45; 252/47

[58] Field of Search ..... 252/47.5, 48.8, 50, 252/51, 51.5 R

[56] References Cited

U.S. PATENT DOCUMENTS

| | | | |
|---|---|---|---|
| 3,904,537 | 9/1975 | Ripple | 252/47.5 |
| 4,358,597 | 11/1982 | Fields | 252/47.5 |
| 4,432,847 | 2/1984 | Fields | 252/47.5 |
| 4,661,273 | 4/1987 | Frangatos | 252/47.5 |

FOREIGN PATENT DOCUMENTS

| | | | |
|---|---|---|---|
| 1008237 | 3/1983 | U.S.S.R. | 252/47.5 |

*Primary Examiner*—William R. Dixon, Jr.
*Assistant Examiner*—James M. Hunter, Jr.
*Attorney, Agent, or Firm*—Fleit, Jacobson, Cohn, Price, Holman & Stern

[57] ABSTRACT

The corrosion inhibited lubricants according to the present invention are comprised of fluorine-containing alkyl carbonyl, fluorine-containing alkylmethyl, ethylcarbonyl, polyperfluorooxyalkylenefluoropropionyl, polyperfluorooxyalkylene copolymerized with oxyfluoro-alkyl carbonyl chains and the like, and which compounds are reacted with hetero cyclic groups and obtained by amidization with polar groups between the radicals and compounds with typical organic end-groups.

The novel compounds referred to above are lubricants with anti-corrosive properties characterized in that they can be represented by the general formula (1) and that the molecular weight of Rf ranges from 200 to 15,000, preferably from 200 to 10,000.

$$Rf—z\ 2(RF)—z \qquad (1)$$

wherein

Rf represents any one of the following groups:

$X(C_3F_6O)_l CFYCO—$ $X(C_3F_6O)_l(CF_2O)_m CFYCO—$ $X(C_2F_4O)_l(CF_2O)_m CFYCO—$ $X(CF_2)_{l-1} CO—$ $X(CF_2)_{l-1} CH_2CO—$ $X(CF_2)_{l-1} CH_2CH_2CO—$ where l is an integer having a value between 3 and 150, and m an integer ranging from 1 to 50, and where X may be H—, F—, $CF_3$—, $C_2F_5$—, $C_3F_7$—, $CF_3$—O—, $C_2F_5O$—, or $C_3F_7O$—, and Y may be F—, $CF_3$—, or $C_2F_5$, respectively.

Z may be classified into any one of the following groups, that is, triazoles, tetrazoles, thiazoles, and thiadiazoles.

1 Claim, No Drawings

CORROSION INHIBITED SYNTHETIC LUBRICANTS

BACKGROUND OF THE INVENTION:

(1) Field of the Invention

The present invention relates to fluorine-containing compounds having hetero cyclic triazoles, tetrazoles, thiazoles, and thiadiazoles of amide as substituents.

The lubricants in accordance with this invention may take the form of solid and liquid or fluid lubricants and can be used for the lubrication and rust-prevention of the contact surfaces of a machine or equipment with moving parts, in which applications they will produce a superior effect.

(2) Description of the Prior Art

Fluorine-containing lubricants as part of the synthetic lubricants are known to include fluorosilicone oil, polyfluorochloroethylene oil, and perfluoroalkyl polyether.

While these compounds are used for their heat resistance and chemical inertness as the main properties favoring their application for this purpose, they present many deficiencies in their lubricating behavior due to their inherent adsoptivity.

In an attempt to overcome this shortcoming, U.S. Pat. No. 3723317 (Mar. 27, 1973) purports to improve these properties by the addition of 1,3,5-triazine to the fluorine-containing lubricant base oil. Recently, it is described in the Japanese Patent Provisional Publication No. 155345/86 of the Italian company Montedison S.p.A. and in the Japanese Patent Provisional Publication No, 93769/88 of the Swiss company Ciba Geigy, and E. J. Soloski, G. J. Moors and Christ Tamborski have published papers on the synthesis of 2- and 2,5-substituted benzoxazoles and benzothiazoles in the Journal of Fluorine Chemistry, 8 (1976), pages 295 through 304, and K. J. L. Paciorek, J. Kaufman, J. H. Nakahara, T. I. Ho, R. H. Kratzer, R. W. Rosser, and J. A. Parker on the Synthesis and Degradations of Fluorinated Heterocyclics III. Perfluoroalkyl and Perfluoroalkylether 1,3,4-Oxadiazoles in the Journal of Fluorine Chemistry, 10 (1977), pages 277 through 288, and Kalathil C. Eapen and Christ Tamborskion the Synthesis of 2-(Perfluoroalkylether)- and -(Perfluoroaryl) Benzothiazoles in the Journal of Fluorine Chemistry 12 (1978), pages 271 through 280 concerning the use of these compounds as anti-corrosive agents.

The application field in which these lubricants have been used in recent years include, for example, such electronic equipment areas as electromagnetic disk surface, connector and electric contactor lubrication, and many of these applications make use of inorganic and organic materials. It has been realized, however, that the service life of the equipment is difficult to extend simply and solely on account of the lubricant's wetting behavior.

Moreover, in bearings with oil and grease lubrication, it has been found that fluorine-containing lubricants have inadequate adhesion to metals so that, in the case of general bearing steels, their use will lead to poorer corrosion protection and a reduced bearing service life, a problem that needs to be resolved. Fluorine-containing lubricants are therefore attracting much attention and are being extensively used, chiefly in those areas in which chemical and heat resistance are an important requirement.

These lubricants have been the object of much research aimed at further development to obtain stabler compounds capable of resisting more severe application conditions.

For this reason, the main application fields for these lubricants have been limited to such areas as the semiconductor industry using non-flammability, corrosive gases and low vapor pressure, the mechanical sector for bearings and machine conveyors and chains operated at high temperatures, and peripheral furnace equipment.

As the superior properties of fluorine-containing lubricants were recognized, however, their application range widened to include factory automation equipment, industrial robots, computer-related equipment, and electrical household appliances.

To permit its use for such equipment, a lubricant is required to meet a variety of specifications, and the fact is that the fluorine-containing lubricants available so far have, in most cases, not been able to fulfill these requirements.

The perfluoroalkyl polyether lubricants, that is, substances in which all hydrogen atoms of the alkyl group have been substituted by fluorine atoms, present difficulties in terms of their poor load resistance properties, if they have a low molecular weight.

By contrast, perfluoropolyethers having a high molecular weight have a low surface tension and favorable wetting properties but lack adhesion to metal surfaces to that, when used in machine parts rotating at a high speed, the lubricant will migrate and thus provide inadequate lubrication.

Further defects of these lubricants are due to their poor compatibility with other types of lubricants (mineral oil type lubricants) and their tendency to disperse under the action of applied centrifugal forces.

If, however, these lubricants are over-stabilized, the result will be that while their adsorption on metals remains poor, their lubricating effect as a lubricant for slide way movement will be very satisfactory in the initial period but this effect tends to diminish as the amount of lubricant appropriate for the lubrication of the equipment will decrease as time passes.

For this reason, some applications have necessitated a certain trade-off by sacrificing of the stability of the lubricant to a given extent for the sake of enhancing its adsorptivity.

SUMMARY OF THE INVENTION

The aim of the present invention, as the result of the most dedicated research on the problems referred to above, is to provide synthetic lubricants with an enhanced adsorption on metals and other inorganic and/or organic materials, improved load resistance properties, a favorable lubricating behavior, and, in particular, outstanding anti-corrosion properties with respect to iron, copper, and silver as well as a low flammability.

DESCRIPTION OF THE PREFERRED EMBODIMENTS

The present invention will be explained in detail hereinunder.

In terms of their general structures, the lubricants according to the present invention are comprised of fluorine-containing alkyl carbonyl, fluorine-containing alkyl methyl, ethyl carbonyl, polyperfluorooxyalkylenefluoropropionyl, polyperfluorooxyalkylene copolymerized with oxyfluoroalkyl carbonyl chains and the like, and which compounds are reacted with hetero cyclic amino groups and obtained by amidization with polar groups between the radicals and compounds with typical organic end-groups.

The novel compounds referred to above are lubricants with anti-corrosive properties characterized in that they can be represented by the general formula (1) and that the molecular weight of Rf ranges from 200 to 15,000, preferably from 200 to 10,000.

$$Rf\text{-}Z,\ 2(Rf)\text{-}Z \qquad (1)$$

wherein

Rf represents any one of the following groups:

$X(C_3F_6O)_l CFYCO-$ $X(C_3F_6O)_l(CF_2O)_m CFYCO-$ $X(C_2F_4O)_l(CF_2O)_m CFYCO-$ $X(CF_2)_{l=1} CO-$ $X(CF_2)_{l=1} CH_2CO-$ $X(CF_2)_{l=1} CH_2CH_2CO-$ where l is an integer having a value between 3 and 150, and m an integer ranging from 1 to 50, and where X may be H—, F—, $CF_3$—, $C_2F_5$—, $C_3F_7$—, $CF_3$—O—, $C_2F_5O$—, or $C_3F_7O$—, and Y may be F—, $CF_3$—, or $C_2F_5$—, respectively.

Z may be classified into any one of the following groups, that is, triazole, tetrazole, thiazole, and thiadiazole. The most typical representatives of the heterocyclic compounds are the amino compounds are that may be described as stated below, and the amide compounds obtained by reaction with these.

(1) Triazole compounds

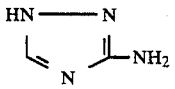

(3-amino 1,2,4-triazole)

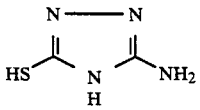

(3-amino-5-mercapto 1,2,4-triazole)

(2) Tetrazole Compounds

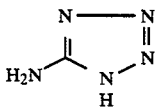

(5-amino-1H—1,2,3,4-tetrazole)

(3) Thiazole Compounds

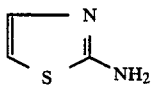

(2-amino thiazole)

(4) Thiadiazoles

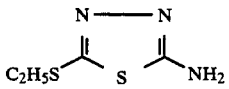

(2-amino-5 ethyl thia-1,3,4-thiadiazole)

-continued

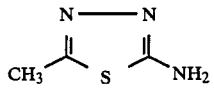

(2-amino-5-methyl-1,3,4-thiadiazole)

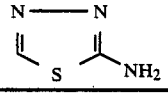

(2-amino-1,3,4-thiadiazole)

The group Rf added to the above formula (1) may be one or two groups which may be identical or different.

If the Rf consists of a fluoroalkyl, fluoroalkyl methyl/fluoroalkyl ethyl carbonyl groups, the compounds will have a pasty or solid consistency in the normal temperature range.

If a liquid compound is to be obtained, a polyperfluorooxymethylene/oxyethylene/oxypropylene group should be introduced, it will be possible to obtain high viscosity and low pour point compounds.

Consequently, these compounds can be used as most effective anti-corrosive lubricants for various types of machines or equipment by making use of their particular features in terms of their high melting point, high viscosity, and low pour point to suit the application purpose.

Nor is it necessary that all of the hydrogen atoms in the Rf group should be substituted by fluorine atoms, as these compounds will present adequate lubricating properties even if only a few percent of the hydrogen atoms have been substituted by fluorine.

Action

The fluorine-containing hetero cyclic amide compounds consisting of triazole, tetrazole, thiazole, and thiadiazole compounds and their various derivates have a density ranging from 1.5 to 1.9 and possess a favorable adsorption with respect to inorganic and organic materials even when used in sliding parts and parts rotating at high speed. They also provide an anti-corrosion effect on ferrous and non-ferrous metals and are further distinguished by a high wetting power due to their low surface tension, poor flammability, and excellent lubricating behavior.

EXAMPLES

Examples will be shown in the following.

The following are some practical examples of the present invention which shall, however, not be limited by, or restricted to, these examples.

The metals in respect of which the compounds in accordance with this invention present a corrosion protection action include, for examples, steel, cast-iron, copper, brass, and aluminum, preferably steel and copper as well as aluminum.

The effectiveness of the synthetic compounds presented in the examples (1) to (4) hereinunder have been measured in the sequence given hereinbelow.

The corrosion tests and corrosion test specimen have been based on the use of an automotive non-mineral oil brake fluid (modified F.M.V.S.S. No.116), with immersion for 30 minutes in an 0.5% (wt./wt.) solution of the anti-corrosive test sample in trichloro-trifluoro ethane and subsequent gradual withdrawal of the test specimen and drying at ambient temperature for 30 minutes.

This specimen was placed in the container described in F.M.V.S.S. No.116, added distilled water and maintained at a temperature of 50° C. for 120 hours to measure its loss in weight. For comparison, test specimen was treated in like manner in a rust protecting humidity cabinet test (ASTMD 1748) to compare its rust preventive effect with that of the compounds in accordance with this invention.

EXAMPLE 1

11 g (0.109 mol) of triethyl amine were added to a solution obtained by dissolving 9.3 g (0.11 mol) of 3-amino- 1,2,4- triazole in 100 ml of refined, dehydrated N,N'-dimethylformamide in an agitator-stirred 500 ml four-necked flask equipped with a reflux cooler and a thermometer, and the resulting solution was stirred until homogeneous.

The resulting solution was kept at a temperature of 5° C., and 200 g (0.108 mol) of perfluoroalkyl polyether perfluoropropionyl chloride [average molecular weight 1,850 (determined by nuclear magnetic resonance spectroscopy), formula:

$$F(C_3F_6O)_{\gamma}C_2F_4COCl,$$

approximately 10, acid number 32, viscosity at 38° C. 90 centi-stokes], dissolved in 200 ml of trichlorotrifluoroethane refined in a separating funnel, were dripped into the above solution for one hour. After dripping, the mixture was stirred for a further 24 hours at 5° C. to bring the reaction to completion.

After the reaction was complete, the remaining trichloro- trifluoroethane was distilled off at 60° C. and a small amount of dilute 0.25N hydrochloric acid and 50 ml of methyl alcohol were added.

The resulting solution was then passed into a separating funnel for separation of the supernatant from the bottom layer. The bottom layer was again treated with 100 ml of N,N' dimethyl formamide and washed out for at least three times with subsequent removal of the unreacted amine. After this, the solvent was removed by vacuum distillation. The residue was purified with distilled water for at least two or three times until no color change was detectable in the presence of methyl orange indicator. 200 ml of trichlorotrifluoro ethane were then added to the bottom layer and dried and desiccated with dehydrated magnesium sulphate. After filtration, the solvent was distilled off. The residue was distilled off in the temperature range 134°–137° C. at a vacuum drawn to 0.3 mm Hg to remove the unreacted perfluoroalkyl polyetherperfluoropropionic acid, when the product was obtained as a light-brown liquid compound in 85% yield.

Determination of the acid number of this liquid compounds by potentiometric titration (AT-200 manufactured by Kyoto Denshi Kogyo Kabushiki Kaisha) gave a value of 0.3 mg KOH/g, and the viscosity at 40° C. was 115 centistokes.

Infrared spectral analysis (performed with an IR spectrometer model IR810 manufactured by Nihon Bunko Kogyo Kabushiki Kaisha) showed that the 1780 $cm^{-1}$ absorption band characteristic of the carboxylic acid had been lost and that amide absorption bands at 1690–1710 $cm^1$ and 3350 $cm^1$ were present instead.

Elemental analysis performed with a YANACO CHN coder MT3 model (manufactured by Kabushiki Kaisha Yanagimoto Seisakusho) revealed 22.5%C and 3.0%N as compared with theoretical values of 22.2%C and 2.9%N. In view of the virtually complete agreement between the analysis results and the theoretical values, it was established that the product formed in the above reaction procedure had the formula (1):

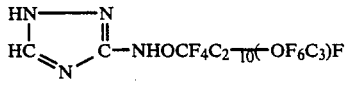

(1)

EXAMPLE 2

9.5 g (0.094 mol) of triethyl amine were added to a solution obtained by dissolving 9.5 g (0.095 mol) of 2-amino thiazole in 100 ml of refined, dehydrated N,N'-dimethylformamide in a stirred 500 ml four-necked flask in the same manner as described in Example 1.

While this mixture was being stirred at a temperature of 5° C., addition was made of 200 g (0.09 mol) of perfluoroalkyl polyether perfluoro propinyl chloride [average molecular weight 2,200 (determined by nuclear magnetic resonance spectroscopy), formula:

$$F(C_3F_6O)_{\gamma}C_2F_4COCl,$$

where l is approximately 12, acid number 25, viscosity at 38° C. 120 centi-stokes], dissolved in 200 ml trichlorotrifluoroethane refined in a separating funnel, by dripping for one hour. After dripping, the mixture was stirred for a further 24 hours at 5° C. to bring the reaction to completion.

After the reaction was complete, the trichlorotrifluoroethane was distilled off at 60° C., and a small amount of 0.25N hydrochloric acid and 50 ml of methyl alcohol were added.

The resulting solution was transferred into a separating funnel for separation of the supernatant and the bottom layer. The bottom layer was washed out, for at least three times with 100 ml of N,N' dimethyl formamide to remove the unreacted amine. After this, the solvent was removed by vacuum distillation and the residue was washed with distilled water until no color change was detectable in the presence of methyl orange indicator. After this, 200 ml of trichlorotrifluoro ethane were added and the residue dried and desiccated with dehydrated magnesium sulphate. After filtration, the solvent was distilled off. The residue was distilled off in the temperature range 152 –158° C. at a vacuum drawn to 0.03 mm Hg to remove the unreacted perfluoroalkylpolyetherperfluoropropionic acid, when the product was obtained as a light-brown liquid compound in 82% yield. Determination of the acid number of this liquid compound in the same manner as described in Example 1 gave a value of 0.5 mg KOH/g, and the viscosity at 40° C. was 135 centi-stokes.

Infrared spectral analysis showed that the 1780 $cm^{-1}$ absorption band characteristic of the carboxylic acid had been lost and that amide absorption bands at 1690–1710 $cm^1$ and 3350 $cm^1$ were present instead.

Elemental analysis revealed 22% C and 1.2% N as compared with theoretical values of 22.5% C and 1.25% N. In view of the virtually complete agreement between the analysis results and the theoretical values, it was established that the product formed in the above reaction procedure had the formula (2):

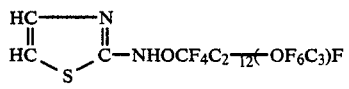

(2)

EXAMPLE 3

21 g (0.207 mol) of triethyl amine were added to a solution obtained by dissolving 21 g (0.208 mol) of 2-amino 1,3,4-thiadiazole in 100 ml of refined, dehydrated N,N'-dimethylformamide in a stirred 500 ml four-necked flask in the same manner as described in Example 1.

While this mixture was being stirred at a temperature of 5° C., addition was made of 200 g (0.2 mol) of perfluoroalkyl polyether perfluoro propinyl chloride [average molecular weight 1,000 (determined by nuclear magnetic resonance spectroscopy), formula:

$$F(C_3F_6O)_l C_2F_4COCl,$$

where l is approximately 5, acid number 65, viscosity at 38° C. 44 centi-stokes], dissolved in 200 ml of trichlorotrifluoroethane refined in a separating funnel, by dripping for one hour. After dripping, the mixture was stirred for a further 24 hours at 5° C. to bring the reaction to completion.

After the reaction was complete, the trichlorotrifluoroethane was distilled off at 60° C., and a small amount of 0.25N hydrochloric acid and 50 ml of methyl alcohol were added.

The resulting solution was then transferred into a separating funnel for separation of the supernatant and the bottom layer. The bottom layer was washed out, for at least three times with 100 ml of N,N' dimethyl formamide; and after removing the unreacted amine, the solvent was removed by vacuum distillation and the residue was washed with distilled water until no color change was detectable in the presence of methyl orange indicator. After this, 200 ml of trichlorotrifluoroethane were added and the residue dried and desiccated with dehydrated magnesium sulphate. After filtration, the solvent was distilled off. The residue was distilled off in the temperature range 80°-100° C. at a vacuum drawn to 0.03 mm Hg to remove the unreacted perfluoroalkylpolyetherperfluoropropionic acid, when the product was obtained as a light-brown compound in 85% yield.

Determination of the acid number of this liquid compound in the same manner as described in Example 1 gave a value of 0.5 mg KOH/g, and the viscosity at 40° C. was 75 centi-stokes.

Infrared spectral analysis showed that the 1780 $cm^{-1}$ absorption band characteristic of the carboxylic acid had been lost and that amide absorption bands at 1680-1700 $cm^1$ and 3350 $cm^1$ were present instead. Elemental analysis revealed 23.0% C and 4% N as compared with theoretical values of 22.2% C and 3.9% N. In view of the virtually complete agreement between the analysis results and the theoretical values, it was established that the product formed in the above reaction procedure had the formula (3):

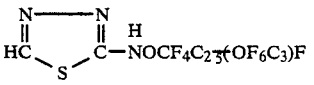

(3)

EXAMPLE 4

21 g (0.207 mol) of triethyl amine were added to a solution obtained by dissolving 32.5 g (0.201 mol) of 2-amino 5-ethyl thia 1,3,4- thiadiazole in 100 ml of refined, dehydrated N,N'-dimethylformamide in a stirred 500 ml four-necked flask in the same manner as described in Example 1.

While this mixture was being stirred at a temperature of 5° C., addition was made perfluoalkyl methly carbonyl chloride (average molecular weight 496.5, formula: ($C_8F_{17}CH_2COCL$, melting point: 29° C., boiling point: 81°-82° C./11 mmHg) dissolved in 100 g (0.201 mol) of perfluorodimethyl cyclohexane (boiling point: 102° C., specific gravity at 25° C.: 1.8—commercial name: FULTEC PP-2), by dripping for one hour. After dripping, the mixture was stirred for a further 24 hours at 5° C. to bring the reaction to completion.

After the reaction was complete, the trichlorotrifluoroethane a small amount of 0.25N hydrochloric acid and 150 ml of methyl alcohol were added.

The resulting solution was then transferred into a separating funnel for separation of the supernatant and the bottom layer. The bottom layer was washed out, for at least three times with 100 ml of N,N' dimethyl formamide and 150 ml of distilled water; and after removing the unreacted amine, the solvent was removed by vacuum distillation and the residue was washed with distilled water until no color change was detectable in the presence of methyl orange indicator, with subsequent drying. The residue was distilled off in the temperature range 115°-120° C. at a vacuum drawn to 0.05 mm Hg to remove the unreacted perfluoroocthylmethylcarboxylic acid, when the product was obtained as a light-brown solid substance in 80% yield (melting point: 90°-92° C).

Determination of the acid number of this liquid compound in the same manner as described in Example 1 gave a value of 0.3 mg KOH/g. Infrared spectral analysis showed that the 1780 $cm^{-1}$ absorption band characteristic of carboxylic acid had been lost and that an absorption bands in the 1210-1330 $cm^{-1}$ range typical of the cf bond as well as strongly pronounced amide absorption bands at 1670-1700 $cm^1$ and 3350 $cm^1$ were present instead.

Elemental analysis revealed 27.5% C, 7.0% N, and 10.0% S (ASTMD 1266) as compared with theoretical values of 27.0% C, 6.7% N, and 10.3% S. In view of the virtually complete agreement between the analysis results and the theoretical values, it was established that the product formed in the above reaction procedure had the formula (4):

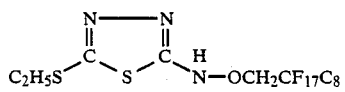

(4)

Table 1 gives the characteristics of the synthetic lubricant compounds with a corrosion-protection effect obtained in the above examples.

TABLE 1

| | Example 1 | Example 2 | Example 3 | Example 4 | Perfluoro Polyether C (1) |
|---|---|---|---|---|---|
| Appearance (Room Temperature) | Clear Brownish Liquid | Clear Brownish Liquid | Clear Brownish Liquid | Brownish Solid | Clear Colorless Liquid |
| Flash Point ASTM D 92 | | | nonflammable | | |
| Viscosity 40° C. C.S. | 115 | 135 | 75 | Melting | 240 |
| Viscosity 100° C. C.S. ASTM D 445 | 11.5 | 12.9 | 8.5 | Point 90–92° C. | 26.0 |
| Viscosity Index ASTM D 2270 | 84.3 | 86.3 | 79 | | 122.3 |
| Strong Acid No. ASTM D 974 | 0.3 | 0.5 | 0.5 | 0.3 | 0.0 |
| Wear Preventive Characteristic | | | | | |
| Mean Hertze Load, kg | 90 | 95 | 85 | | 98 |
| Incipient Seizure, kg | 230 | 250 | 220 | | 200 |
| Weld load, kg ASTM D 2783 | 330 | 360 | 300 | | 398 |
| Corrosion Test | | | 50° C., 120 hrs. | | |
| Steel mg/cm$^2$ | +0.02 | +0.01 | −0.02 | +0.01 | −0.1 |
| Aluminum mg/cm$^2$ | −0.02 | −0.01 | −0.02 | −0.01 | −0.05 |
| Cast Iron mg/cm$^2$ | −0.03 | −0.02 | +0.01 | +0.01 | −0.15 |
| Brass mg/cm$^2$ | −0.03 | −0.02 | −0.04 | −0.02 | −0.2 |
| Copper mg/cm$^2$ | −0.02 | −0.03 | −0.02 | −0.02 | −0.1 |
| Federal Motor Vehicle Safety Standard No. 116 | | | | | |
| Test for Rust Protection in the Humidity Cabinet ASTM D 1748 | 300 hrs No Rust | 300 hrs No Rust | 300 hrs No Rust | 300 hrs No Rust | 30 min Rust |

(1) Perfluoropolyether C manufactured by Dupont U.S.A. under the trade name Krytox 143AC (average molecular weight: 6,250)
chemical structure:

$$F(\underset{\underset{CF_3}{|}}{CF}-CF_2-O)_{37}-CF_2CF_3$$

The fluorine-containing compounds according to the present invention in which triazole, tetrazole, thiazole, and thiadiazole rings are bonded to amides, have properties not found in the conventional lubricants and their use provides superior characteristics in terms of the adsorption behavior on metal surfaces, corrosion prevention, and lubricating properties under high loads.

In addition, the low flammability of these lubricants under handling conditions ensures safety in use.

If these compounds are used either on their own or in combination with perfluoro polyether oil or added to a perfluoro polyether type greases, they will therefore provide a very favorable lubricating action over a long time when used for the lubrication of the contact surfaces of rotating equipment of any kind and equipment with moving parts, being suitable for luibricating all kinds of equipment and magnetic recording devices, connectors and the like.

While there has been described what are at present considered to be preferred embodiments of the invention, it will be understood that various modifications may be made thereto, and it is intended that the appended claims cover all such modifications as fall within the true spirit and scope of the invention.

What is claimed is:

1. Anti-corrosion synthetic lubricants of the formula Rf—NH—Z or 2(Rf—NH)Z, wherein Rf has a molecular weight of from 200 to 15,000 and is a member selected from the group consisting of:

$X(C_3F_6O)_l CFYCO$, $X(C_3F_6O)_l(CF_2O)_m CFYCO$, $X(C_2F_4O)_l(CF_2O)_m CFYCO$, $X(CF_2)_{l-1}CO$, $X(CF_2)_{l-1}CH_2CO$, and $X(CF_2)_{l-1}CH_2CH_2CO$, wherein l is an integer from 3 to 150, m is an integer from 1 to 50, X is H—, F—, $CF_3$—, $C_2F_5$—, $C_3F_7$—, $CF_3O$—, $C_2F_5O$—, or $C_3F_7O$—, and Y is F—, $CF_3$—, or $C_2F_5$—; and Z is a heterocyclic group selected from the group consisting of triazole, tetrazole, thiazole and thiadiazole groups.

* * * * *